US009200815B2

(12) United States Patent
Fleagle et al.

(10) Patent No.: US 9,200,815 B2
(45) Date of Patent: Dec. 1, 2015

(54) VENTILATION DUCTING ARRANGEMENT

(75) Inventors: Steven S. Fleagle, Syracuse, IN (US); Kevin J. Carson, Grand Junction, CO (US)

(73) Assignee: ABC Industries, Inc., Warsaw, IN (US)

( * ) Notice: Subject to any disclaimer, the term of this patent is extended or adjusted under 35 U.S.C. 154(b) by 544 days.

(21) Appl. No.: 13/594,511

(22) Filed: Aug. 24, 2012

(65) Prior Publication Data

US 2013/0220469 A1 Aug. 29, 2013

(51) Int. Cl.

| | |
|---|---|
| ***F24F 13/02*** | (2006.01) |
| ***E21F 17/02*** | (2006.01) |
| ***E21F 1/04*** | (2006.01) |

(52) U.S. Cl.

CPC ..... *F24F 13/0218* (2013.01); *E21F 1/04* (2013.01); *E21F 17/02* (2013.01); *F24F 13/0245* (2013.01); *F24F 13/0254* (2013.01); *Y10T 29/49826* (2015.01)

(58) Field of Classification Search

CPC ..... F24F 13/0218; F24F 13/0245; F24F 13/0254; F24F 13/02; F24F 13/209; E21F 1/04; E21F 1/06; E21F 17/02

USPC ..... 138/107, 118, 106, DIG. 4

See application file for complete search history.

(56) References Cited

U.S. PATENT DOCUMENTS

| | | | | |
|---|---|---|---|---|
| 2,895,510 | A * | 7/1959 | Rebut | 138/107 |
| 4,944,973 | A * | 7/1990 | Follette | 428/36.1 |
| 5,094,273 | A | 3/1992 | Eagleton | |
| 5,989,006 | A * | 11/1999 | Godeau et al. | 425/392 |
| 6,354,937 | B1 * | 3/2002 | Crook | 454/292 |
| 2013/0233434 | A1 | 9/2013 | Adams et al. | |

* cited by examiner

*Primary Examiner* — J. Casimer Jacyna
(74) *Attorney, Agent, or Firm* — Keith Swedo

(57) ABSTRACT

A ventilation ducting arrangement includes a flexible conduit having an inner surface defining a channel carrying a flow of air. First connectors are aligned in a length direction along a length of the inner surface of the conduit. Second connectors are aligned along the length direction. Each of the second connectors has a position along the length direction that is the same as a position of a corresponding first connector along the length direction but that is diametrically opposed to the position of the corresponding first connector relative to a circumference of the inner surface. Each of a plurality of fastening devices interconnects a respective one of the first connectors and a respective one of the second connectors such that a distance between the interconnected first connector and the interconnected second connector is limited by a length of the fastening device.

20 Claims, 6 Drawing Sheets

VENTILATION DUCTING ARRANGEMENT

BACKGROUND OF THE INVENTION

1. Field of the Invention

The present invention relates to ducting arrangements for carrying fresh and/or air conditioned air within underground mines and tunnels.

2. Description of the Related Art

Ventilation ducts are used in carrying fresh and/or air conditioned air to work locations in underground mines and tunnels such as coal mines and mines containing precious metals including silver and gold. As in buildings, the ducts are typically installed against the ceiling of the mine or tunnel so that they are out of the way of human and vehicles traveling through and working in the mine or tunnel. As opposed to ducts in buildings, however, which are typically made of a rigid material such as sheet metal, ducts in mines or tunnels are often made of a flexible material such as a high strength PVC fabric with a polyester substrate. An advantage of a flexible material is that the duct can conform to the undulations of the roof and walls, which are common in mines and tunnels. Another advantage is that flexible ducts can be easily deflected or compressed in order to accommodate and make room for the passing of machinery and vehicles which may occasionally pass by with minimal or no clearance.

The advantageous flexibility of the duct material may also be a disadvantage in some respects, however. For example, the high pressure of the air carried by the duct may cause the flexible duct to tend to take on a circular cross-sectional shape, rather than a more desirable rectangular shape or oval shape. A rectangular-shaped or oval-shaped duct may conform better to the flat ceiling and narrow entry widths of the mine/tunnel, and may thereby stay more out of the way of vehicles, humans and machinery that travel and operate within the mine/tunnel.

What is neither disclosed nor suggested in the conventional art is a flexible ventilation duct that can maintain a low-profile cross-sectional shape when carrying a high pressure flow of air or other gas.

SUMMARY OF THE INVENTION

The invention is directed to an underground ventilation duct in which opposing internal sides of the duct are attached or fastened together such that the opposing internal sides of the duct cannot be moved away from each other by greater than a predetermined distance. Thus, when the internal opposing points of attachment are vertically aligned with each other, the height of the duct is limited such that the duct takes on an oval shape and stays close to the ceiling when carrying a high pressure flow of air.

In one embodiment, the invention comprises a ventilation ducting arrangement including a flexible conduit having an inner surface defining a channel carrying a flow of air. A plurality of first connectors are substantially aligned in a length direction along a length of the inner surface of the conduit. A plurality of second connectors are substantially aligned along the length direction. Each of the second connectors has a position along the length direction that is substantially the same as a position of a corresponding first connector along the length direction but that is substantially diametrically opposed to the position of the corresponding first connector relative to a circumference of the inner surface. Each of a plurality of fastening devices interconnects a respective one of the first connectors and a respective one of the second connectors such that a distance between the interconnected first connector and the interconnected second connector is limited by a length of the fastening device.

In another embodiment, the invention comprises a ventilation ducting arrangement including a flexible conduit having an inner surface defining a channel carrying a flow of air. An elongate first flange is aligned in a length direction along a length of the inner surface of the conduit. The first flange includes a plurality of first grommets spaced apart along the length of the first flange. An elongate second flange is aligned in the length direction along the length of the inner surface of the conduit such that the second flange is substantially parallel to the first flange. The second flange has a position that is substantially diametrically opposed to the position of the first flange relative to a circumference of the inner surface. The second flange includes a plurality of second grommets spaced apart along the length of the second flange. Each second grommet has a position along the length direction that is substantially the same as a position of a corresponding first grommet along the length direction. Each of a plurality of fastening devices interconnects a respective one of the first grommets and a respective one of the second grommets such that a distance between the interconnected first grommet and the interconnected second grommet is limited by a length of the fastening device.

In yet another embodiment, the invention comprises a method of manufacturing a ventilation ducting arrangement, including providing a rectangular sheet(s) of flexible material having first and second opposing lateral edges. A plurality of first connectors are attached to a first side of the sheet such that the first connectors are aligned in a length direction parallel to each of the two opposing lateral edges of the sheet. The first connectors are substantially equidistant from the two opposing lateral edges of the sheet. A plurality of second connectors are attached to the first side of the sheet such that the second connectors are aligned along the second lateral edge. Each of the second connectors has a position along the length direction that is substantially the same as a position of a corresponding first connector along the length direction. An elongate fastening device is used to interconnect a respective one of the first connectors and a respective one of the second connectors such that a distance between the interconnected first connector and the interconnected second connector is limited by a length of the fastening device. A portion of the second lateral edge that is adjacent to the attached second connector is attached to a portion of the first lateral edge that has a position along the length direction that is substantially the same as a position of the portion of the second lateral edge along the length direction. The fastening step precedes the attaching step. The fastening steps and the attaching steps are alternatingly repeated until each of the first connectors is fastened to a respective one of the second connectors, and the first lateral edge is attached to the second lateral edge substantially along entireties of the first and second lateral edges.

An advantage of the invention is that the duct maintains an oval cross-sectional shape that hugs the ceiling or rib of the mine/tunnel when the duct carries a high pressure flow of air.

Another advantage is that the duct accommodates a high air flow rate and does not unduly restrict the air flowing therethrough.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
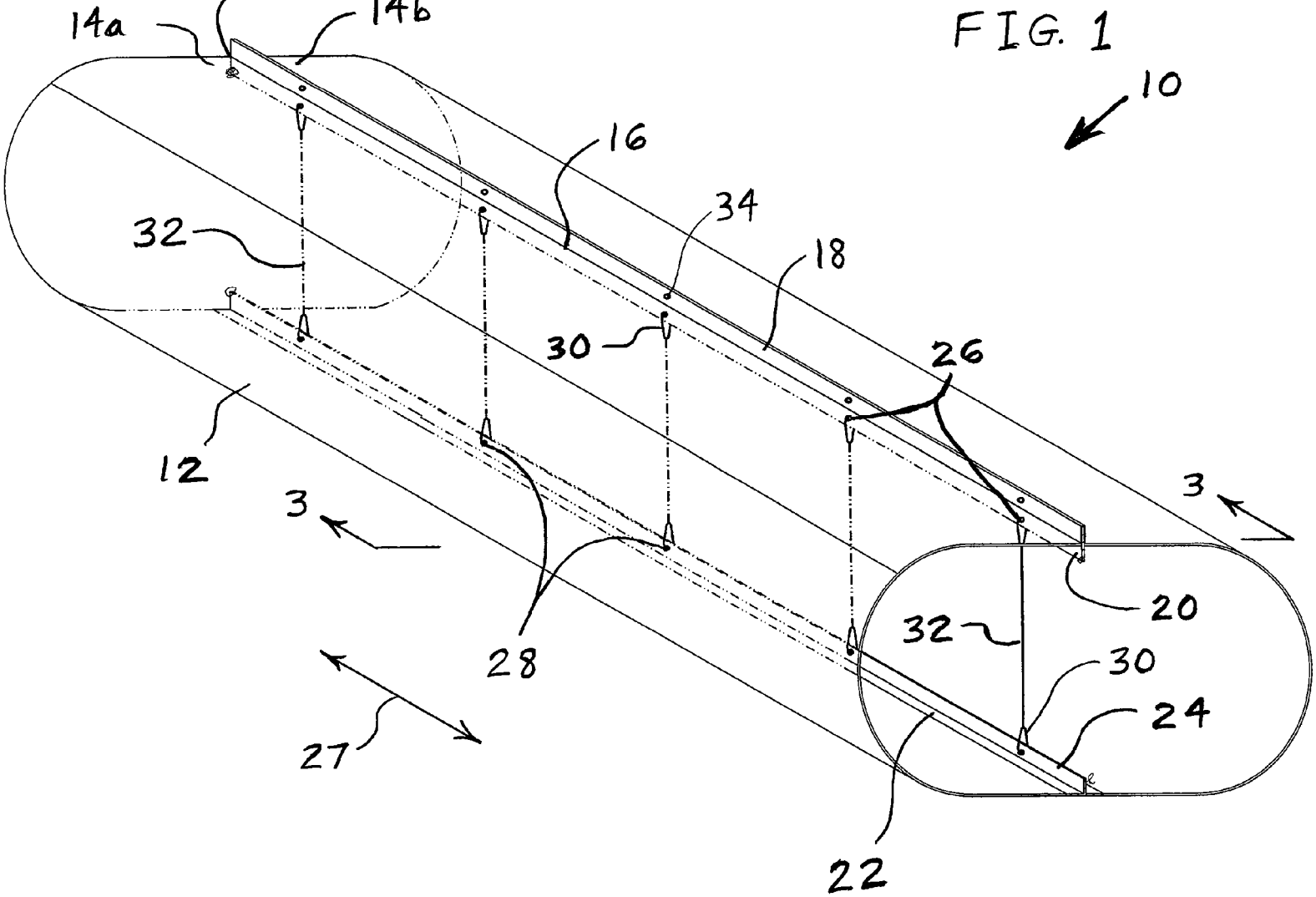
FIG. 1 is a schematic perspective view of one embodiment of a ventilation ducting arrangement of the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PRESENT INVENTION

Figure 2:
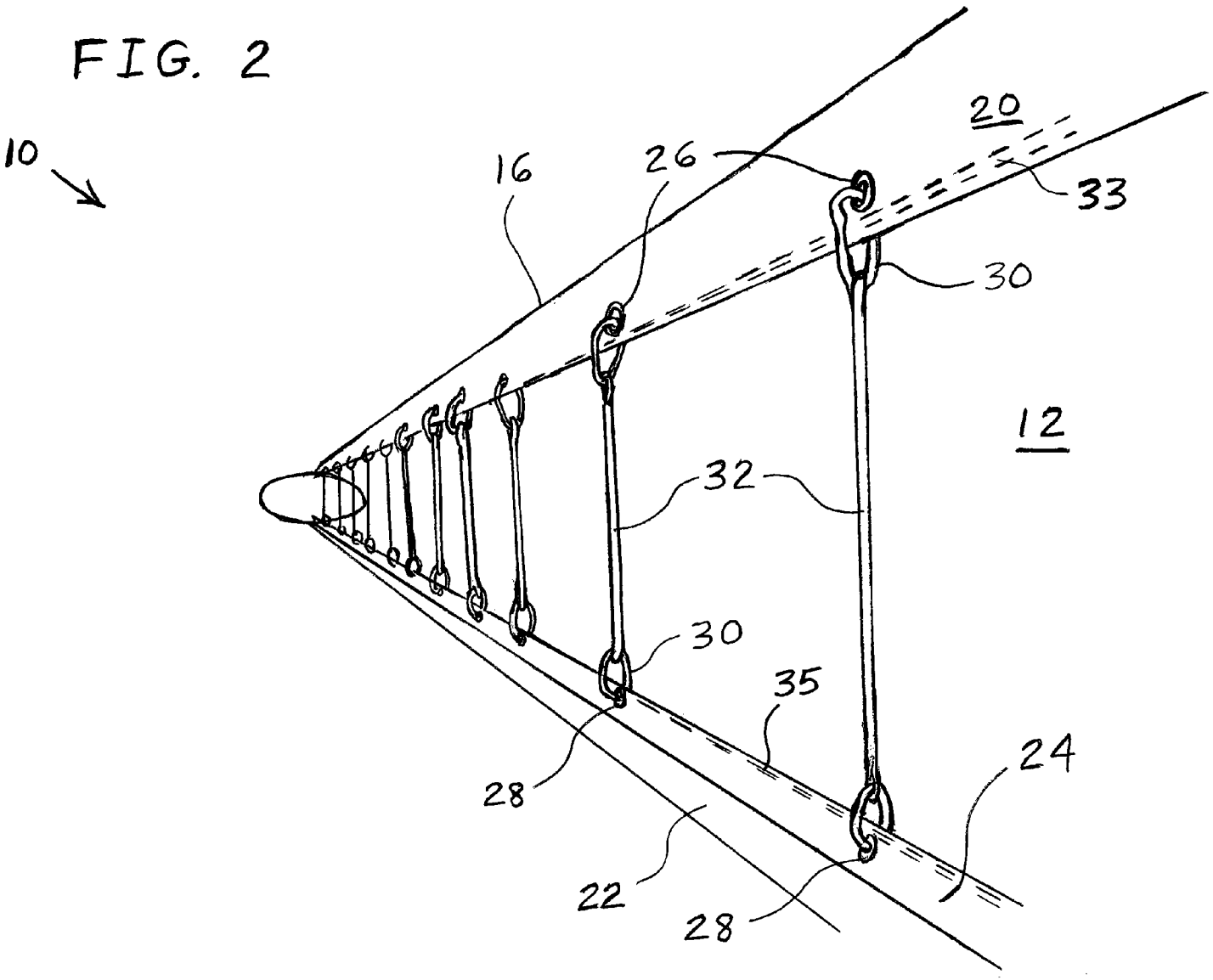
FIG. 2 is an internal perspective view along the length of the arrangement of FIG. 1.

Referring now to the drawings, and particularly to FIGS. 1 and 2, there is illustrated one embodiment of a ventilation ducting arrangement 10 of the present invention including a flexible body 12 which may be formed of one or more sheets of fabric or plastic. In one embodiment, body 12 is formed of a high strength PVC polyester substrate having a layer of PVC film (not shown) on both sides. In one embodiment, body 12 is formed of a single monolithic sheet having its opposite ends 14*a* and 14*b* joined together at a T-seam 16 where body 12 is attached to an upper flange 18 that projects upwardly and to a lower flange 20 that projects downwardly. Opposite ends 14*a* and 14*b*, upper flange 18 and lower flange 20 may be attached together at T-seam 16 by sewing, hot welding or radio frequency (RF) welding, for example. Thus, body 12 may be in the form of a flexible conduit having an inner surface defining a channel that carries a flow of air.

A T-shaped flange 22 may be attached to an inner surface of body 12 at a location that is 180 degrees opposite from the location of lower flange 20. Flange 22 may be attached to body 12 by sewing, hot welding or radio frequency (RF) welding, for example. A middle leg 24 of flange 22 may extend in an upward direction toward lower flange 20.

Lower flange 20 includes grommets 26 which are evenly spaced-apart along the length of flange 20. In a particular embodiment, grommets 26 are spaced approximately between twelve inches and thirty inches apart. In a specific embodiment, grommets 26 are spaced twenty-four inches apart. Thus, grommets 26 may function as connectors which are aligned in length directions indicated by double arrow 27 along a length of the inner surface of body 12.

Middle leg 24 of flange 22 may include grommets 28 each corresponding to a respective one of grommets 26. Grommets 28 may be at the same positions along the length of middle leg 24 as grommets 26. Thus, each pair of corresponding grommets 26, 28 may be vertically aligned with each other. Grommets 28 may function as connectors which are aligned along length direction 27. Each of grommets 28 has a position along length direction 27 that is the same as, or equivalent to, a position of a corresponding one of grommets 26 along length direction 27. However, the position of each of grommets 28 is diametrically opposed to (i.e., 180 degrees offset from) the position of the corresponding grommet 26 relative to a circumference of the inner surface of body 12.

A respective carabiner 30, or similar linking device, may be received in each of grommets 26, 28. Each pair of carabiners 30 received in each pair of corresponding grommets 26, 28 may be attached to respective opposite ends of a corresponding steel aircraft cable 32 or other high strength flexible cable. Each cable 32 and corresponding pair of carabiners 30 may function as a fastening device interconnecting a respective one of grommets 26 and a respective one of grommets 28 such that a distance between grommet 26 and grommet 28 is limited by the length of the assembly that includes cable 32 and the corresponding pair of carabiners 30. The limited distance between grommets 26 and 28 may be less than 70% of the circumference of the inner surface of body 12 divided by $\pi$.

Alternatively, cable 32 may be formed of bungee cord, or a similar material that stretches somewhat when pulled upon, but yet may maintain a steady-state length even with pulling force being exerted thereupon.

Upper flange 18 may include grommets 34 along its length by which arrangement 10 may be attached to the ceiling of a mine or tunnel via carabiners, clips and cables (not shown) or other similar connecting devices. Although grommets 34 are shown in positions corresponding to the positions of grommets 26 along the length of arrangement 10, it is to be understood that grommets 34 may be in different positions along the length of arrangement 10, and the spacing between grommets 34 may be different from the spacing between grommets 26. Grommets 34 may function as connectors on an upper portion of an outer surface of body 12 such that body 12 may be fastened to a ceiling of a mine or of a tunnel via grommets 34.

In addition to, or instead of grommets 34, the upper outer surface of body 12 may include metal hooks or loops (not shown) that are laterally or circumferentially spaced away from flange 18 by which arrangement 10 may be attached to the ceiling of a mine or tunnel via carabiners and cables (not shown) or other similar connecting devices. An oval loop of semi-rigid wire (not shown) may be wrapped in the material of body 12 to define one or both of the two opposite oval openings of arrangement 10. Aircraft cables 33, 35 may be embedded in the respective distal ends of flange 20 and middle leg 24, respectively, in order to add structural strength and prevent the material of flange 20 and middle leg 24 from tearing from the radial forces exerted on grommets 26, 28.

Figure 3:
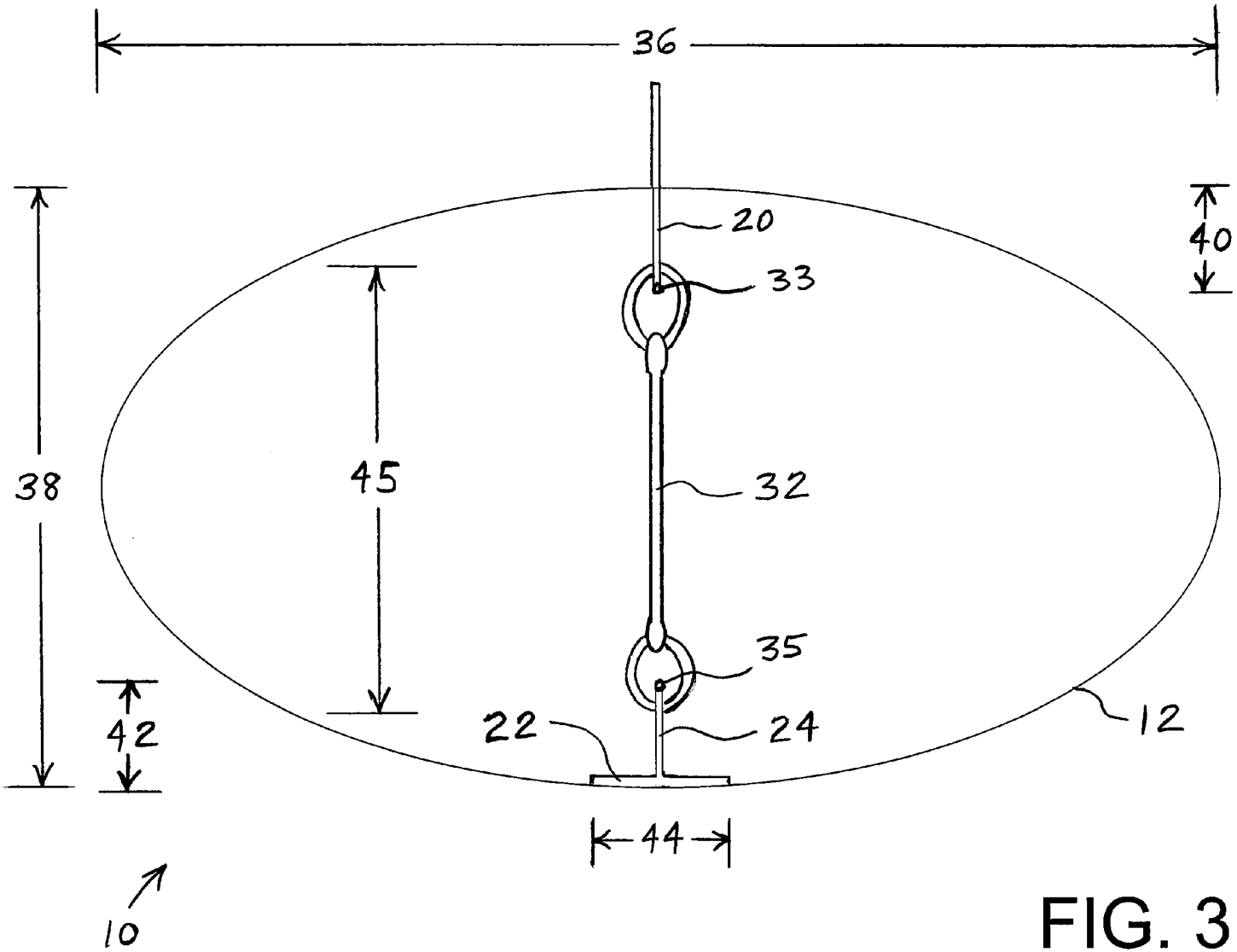
FIG. 3 is a schematic cross-sectional view along line 3-3 in FIG. 1.

A cross-sectional view of arrangement 10 along line 3-3 in FIG. 1 is illustrated in FIG. 3. A width 36 of body 12 may be approximately between twenty and ninety inches. A height 38 of body 12 may be approximately between eleven and forty-eight inches. A ratio between width 36 and height 38 may be approximately between 1.8 and 2.0. In a particular embodiment, the ratio between width 36 and height 38 is approximately between 1.84 and 1.93. A height 40 of lower flange 20 in a radial direction and a height 42 in a radial direction of middle leg 24 may both be approximately between two inches and six inches. In a specific embodiment, height 40 and a height 42 are both approximately between one and one-half and four and one-half inches. Thicknesses of lower flange 20 and middle leg 24 may both be less than one-half inch. A width 44 of flange 22 may be approximately between two inches and six inches. In a specific embodiment, width 44 is approximately between three inches and five and one-half inches. Cable 32 may have a thickness of approximately between one-sixteenth inch and one-half inch. The dimensions of height 40 of lower flange 20, height 42 of middle leg 24, and the width of cable 32 are relatively small compared to the large dimensions of width 36 and height 38 of body 12, and the large distances between adjacent cables 32. Accordingly, lower flange 20, middle leg 24 and cable 32 do not substantially impede the flow of air or create turbulence within body 12.

A length 45 of the fastening device including cable 32 and carabiners 30 may be approximately between seven and forty-four inches. Length 45 may be fixed if cable 32 is made of a non-stretchable material such as steel.

During use, the high pressure flow of air through body 12 causes body 12 to expand in radially outward directions. However, the pressure within body 12 is preferably not great enough to tear or cause holes in body 12, or to break the attachment between opposing flanges 20, 24 through carabiners 30 and cable 32. Because body 12 can expand no farther in vertical directions than allowed by the lengths of cable 32, the flexible body 12 expands to a greater extent in the horizontal directions than in the vertical directions. This configuration has the advantage that arrangement 10 is spread out relatively close to the ceiling above, and does not hang down vertically to the point where it may interfere with machinery, vehicles and humans below.

Figure 4:
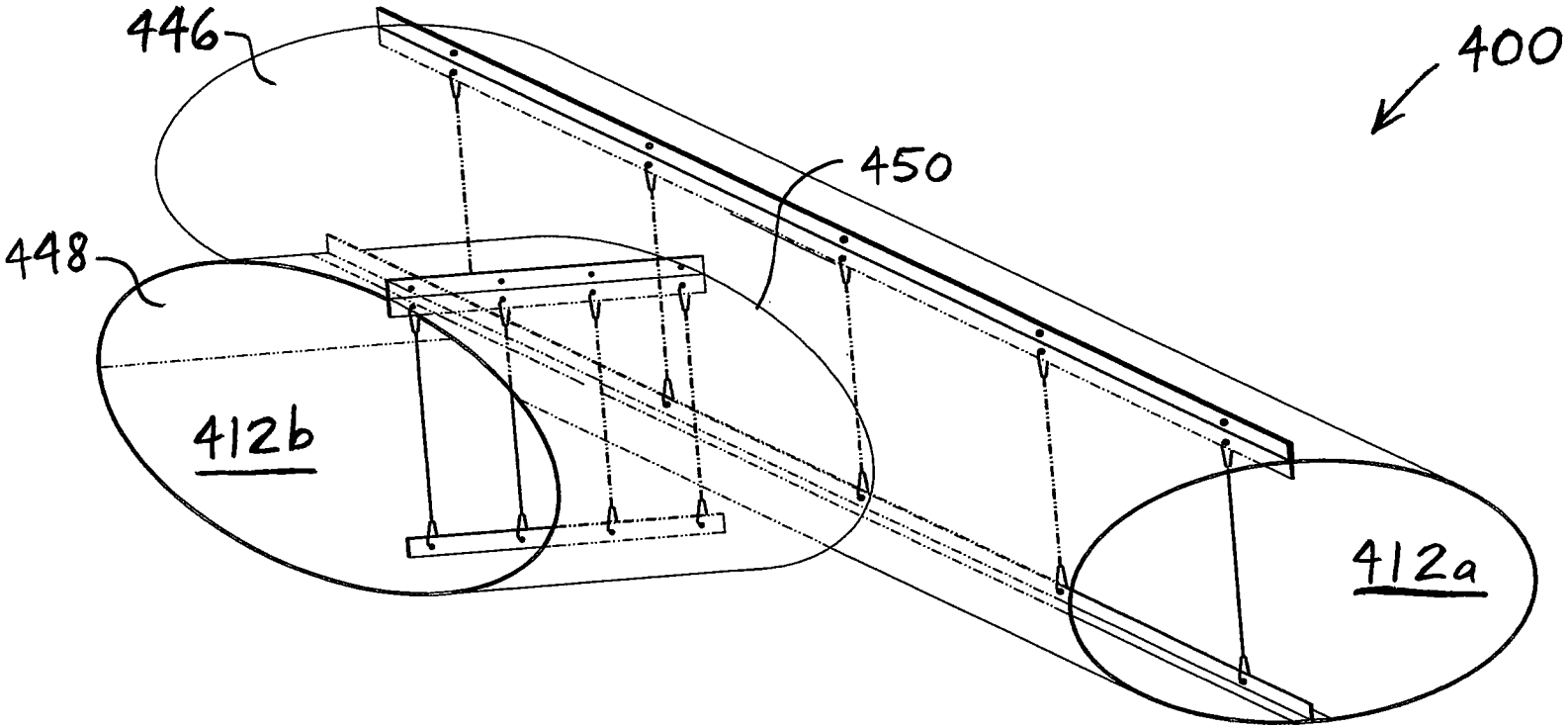
FIG. 4 is a schematic perspective view of another embodiment of a ventilation ducting arrangement of the present invention.

Another embodiment of a T-shaped ventilation ducting arrangement 400 of the present invention is shown in FIG. 4 including two linear ducts 446 and 448 which are in fluid communication with each other and oriented at a right angle relative to each other. That is, body 412*a* of duct 446 has a substantially oval-shaped through-hole 450 which is fluidly connected with a proximal end of the interior of body 412*b* of duct 448. Arrangement 400 may carry a flow of air such that the flow branches off in two different directions. Alternatively, arrangement 400 may carry two separate flows of air such that the two flows merge together into a single flow of air that is carried in one single direction. Other features of arrangement 400 may be substantially similar to the features of arrangement 10, and thus are not described in detail herein in order to avoid needless repetition.

Figure 5A:
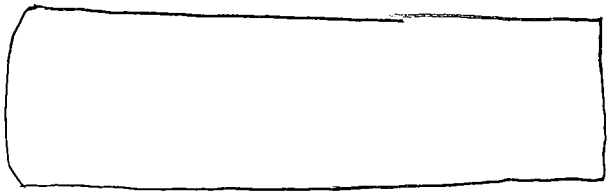
FIG. 5*a* is an overhead plan view of the arrangement of FIG. 1.
Figure 5B:
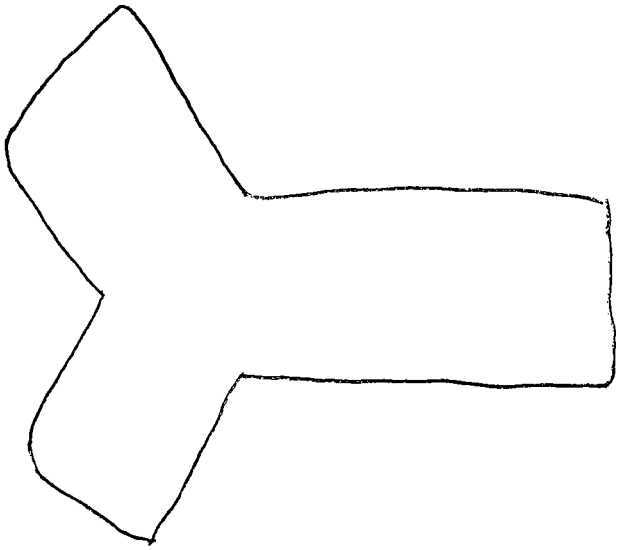
FIG. 5*b* is an overhead plan view of yet another embodiment of a ventilation ducting arrangement of the present invention.
Figure 5C:
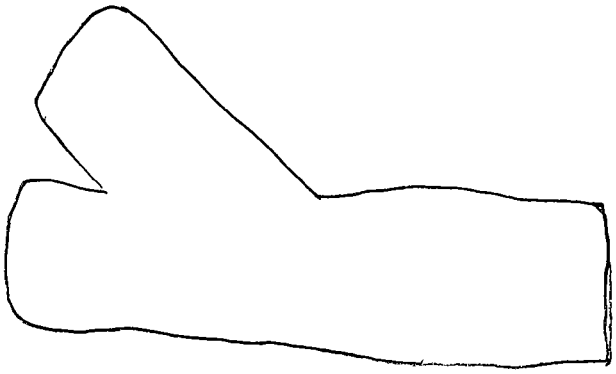
FIG. 5*c* is an overhead plan view of still another embodiment of a ventilation ducting arrangement of the present invention.

FIG. 5*a* is an overhead plan view of arrangement 10 of FIG. 1, showing the single duct in a linear configuration. As shown in FIG. 4, a ventilation duct arrangement of the invention may also be in a T-shaped configuration. It is also within the scope of the invention for a ventilation duct arrangement to be L-shaped, i.e., to include a right or left angle turn. FIG. 5*b* shows another embodiment in which the duct branches off in a Y-shaped configuration in which each branch veers from the trunk at an angle of about thirty degrees. FIG. 5*c* shows yet another embodiment in which the duct branches off in a Y-shaped configuration in which one branch veers from the trunk at an angle of about thirty degrees, and the other branch continues in the same linear direction as the trunk.

Figure 6:
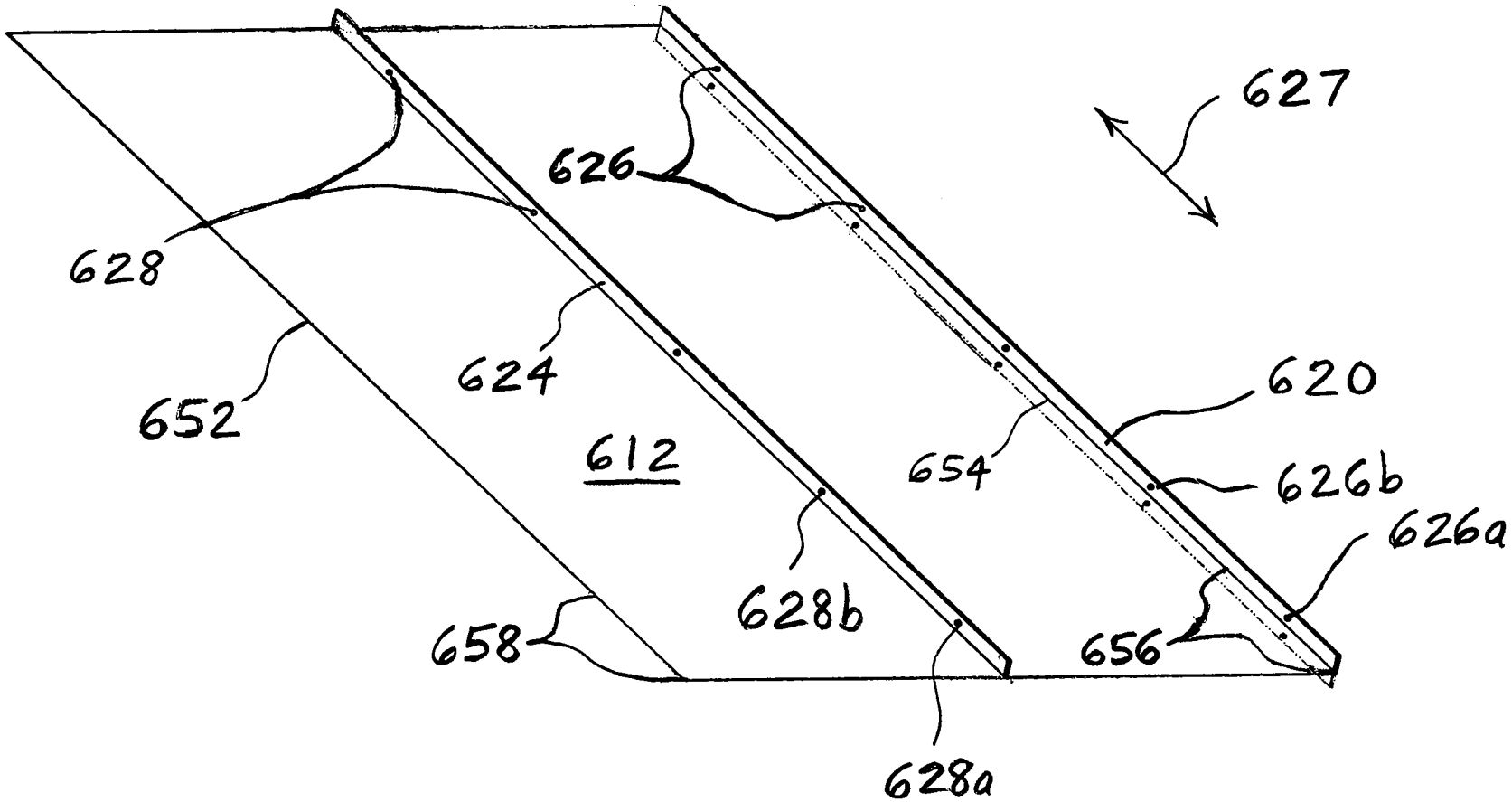
FIG. 6 is a perspective view of one embodiment of the body and flanges of a conduit before being assembled into the state shown in FIGS. 1-3.

During assembly, a rectangular sheet(s) 612 (FIG. 6) of flexible material having opposing lateral edges 652 and 654 is provided. A plurality of first connectors in the form of grommets 628 on a flange 624 are attached to one side of sheet 612 such that the first connectors are aligned in length directions 627 parallel to each of the two opposing lateral edges 652, 654 of sheet 612. Grommets 628 are substantially equidistant from the two opposing lateral edges 652, 654 of sheet 612. A plurality of second connectors in the form of grommets 626 on a flange 620 are attached to the one side of the sheet such that grommets 626 are aligned along lateral edge 654. Each of grommets 626 has a position along length directions 627 that is substantially the same as a position of a corresponding grommet 628 along length directions 627. An elongate fastening device such as cable 32 and carabiners 30 may be used to interconnect a respective one of grommets 626 and a respective one of grommet 628 (e.g., grommets 626*a* and 628*a*) such that a distance between grommets 626, 628 is limited by a length of the fastening device. After grommets 626, 628 are interconnected, a portion of lateral edge 654 that is adjacent to the attached grommet 626 is attached to a portion of lateral edge 652 that has a position along length directions 627 that is substantially the same as a position of the portion of lateral edge 654 along length directions 627. For example, a portion 656 of lateral edge 654 that is adjacent to the attached grommet 626*a* is attached, such as by sewing, hot welding, or RF welding, to a portion 658 of lateral edge 652 that has a position along length directions 627 that is substantially the same as a position of portion 656 of lateral edge 654 along length directions 627. The fastening steps and the attaching steps are alternatingly repeated until each of grommets 626 is fastened to a respective one of grommets 628, and lateral edge 654 is attached to lateral edge 652 all along lateral edges 652, 654. For example, grommets 626*b*, 628*b* may be fastened together by a cable 32 and a pair of carabiners 30, and then the corresponding portions of lateral edges 652, 654 may be attached together such that there is an airtight, closed seam between this new attachment and the attachment between portions 656, 658. The fastening steps and the attaching steps may be alternatingly repeated up the line in sequence until all grommets are fastened and edge 652 is completely attached to edge 654.

According to the above described manufacturing procedure, and with reference to FIGS. 1-3, carabiners 30 and cables 32 may be latched into each of grommets 28 of middle leg 24 before T-seam 16 is created. Then, operations may alternate between attaching one of the other carabiners 30 to a grommet 26 of flange 20 and sewing, hot welding or RF welding a corresponding portion of T-seam 16. In one embodiment, a carabiner 30 is latched into a grommet 26 of flange 20 immediately before a corresponding portion of T-seam 16 above the grommet 26 is hot welded or otherwise formed. Thereafter, assembly operations alternate between latching a next carabiner 30 into a next grommet 26 and hot welding the next corresponding portion of T-seam 16 above the grommet 26.

While this invention has been described as having an exemplary design, the present invention may be further modified within the spirit and scope of this disclosure. This application is therefore intended to cover any variations, uses, or adaptations of the invention using its general principles.

What is claimed is:

1. A ventilation ducting arrangement comprising:

a flexible conduit having an inner surface defining a channel configured to carry a flow of air;

a plurality of first connectors substantially aligned in a length direction along a length of the inner surface of the conduit;

a plurality of second connectors substantially aligned in the length direction along the length of the inner surface of the conduit, each of the second connectors having a position along the length direction that is substantially the same as a position of a corresponding said first connector along the length direction but that is substantially diametrically opposed to the position of the corresponding said first connector relative to a circumference of the inner surface; and a plurality of flexible fastening devices, each said fastening device interconnecting a respective one of the first connectors and a respective one of the second connectors such that a distance between the interconnected first connector and the interconnected second connector is limited by a length of the fastening device.

2. The arrangement of claim 1 wherein each said fastening device is linear.

3. The arrangement of claim 2 wherein each said fastening device is linear while the length of said fastening device is limiting the distance between the interconnected first connector and the interconnected second connector.

4. The arrangement of claim 1 wherein each said fastening device has a thickness in the length direction of less than one inch, and wherein distances between adjacent pairs of the fastening devices are at least twelve inches.

5. The arrangement of claim 1 wherein the limited distance between the interconnected first connector and the interconnected second connector is less than 70% of the circumference of the inner surface divided by $\pi$.

6. The arrangement of claim 1 wherein the length of each said fastening device is fixed.

7. The arrangement of claim 1 further comprising a plurality of third connectors on an upper portion of an outer surface of the flexible conduit such that the conduit may be fastened to a ceiling of a mine or of a tunnel via the third connectors.

8. A ventilation ducting arrangement comprising:

a flexible conduit having an inner surface defining a channel configured to carry a flow of air;

an elongate first flange aligned in a length direction along a length of the inner surface of the conduit, the first flange including a plurality of first grommets spaced apart along a length of the first flange;

an elongate second flange aligned in the length direction along the length of the inner surface of the conduit such that the second flange is substantially parallel to the first flange, the second flange having a position that is substantially diametrically opposed to the position of the first flange relative to a circumference of the inner surface, the second flange including a plurality of second grommets spaced apart along a length of the second flange, each said second grommet having a position along the length direction that is substantially the same as a position of a corresponding said first grommet along the length direction; and a plurality of fastening devices each having a linear state, each said fastening device interconnecting a respective one of the first grommets and a respective one of the second grommets such that a distance between the interconnected first grommet and the interconnected second grommet is limited by a length of the fastening device while the fastening device is in the linear state.

9. The arrangement of claim 8 wherein each said fastening device is flexible and has a thickness in the length direction of less than one inch.

10. The arrangement of claim 8 wherein each of said first flange and said second flange has a height in a radial direction of approximately between two inches and six inches.

11. The arrangement of claim 8 wherein distances between adjacent pairs of the fastening devices are at least twelve inches.

12. The arrangement of claim 8 wherein the limited distance between the interconnected first grommet and the interconnected second grommet is less than 70% of the circumference of the inner surface divided by $\pi$.

13. The arrangement of claim 8 wherein the length of each said fastening device is fixed.

14. The arrangement of claim 8 further comprising an elongate third flange aligned in the length direction along a length of an outer surface of the conduit such that the third flange is substantially parallel to each of the first flange and the second flange, the third flange including a plurality of third grommets spaced apart along a length of the third flange such that the conduit may be fastened to a ceiling of a mine or of a tunnel via the third grommets.

15. The arrangement of claim 7 wherein the first connectors are substantially aligned along an uppermost portion of the inner surface of the flexible conduit, and the second connectors are substantially aligned along a lowermost portion of the inner surface of the flexible conduit.

16. The arrangement of claim 14 wherein the first flange is aligned along an uppermost portion of the inner surface of the flexible conduit, and the second flange is aligned along a lowermost portion of the inner surface of the flexible conduit.

17. A ventilation ducting arrangement comprising:

a flexible conduit having an inner surface defining a channel configured to carry a flow of air;

a plurality of flexible, elongate fastening devices each having a taut state, each said elongate fastening device having a first end and an opposite second end;

first connection means for connecting each of the first ends of the elongate fastening devices to a respective first portion of the inner surface of the conduit such that the first ends are substantially aligned along a length direction of the conduit; and second connection means for connecting each of the second ends of the elongate fastening devices to a respective second portion of the inner surface of the conduit such that the second ends are substantially aligned along the length direction of the conduit, such that each of the second ends is substantially diametrically opposed to a respective one of the first ends relative to a circumference of the inner surface, and such that a distance between each said first portion of the inner surface of the conduit and a respective said second portion of the inner surface of the conduit is less than 28% of the circumference of the inner surface while a respective said fastening device is in the taut state.

18. The arrangement of claim 17 further comprising third connection means for fastening the conduit to a ceiling of a mine or of a tunnel.

19. The arrangement of claim 17 wherein each said fastening device is has a respective substantially fixed length.

20. The arrangement of claim 17 wherein distances between adjacent pairs of the fastening devices are greater than the lengths of the fastening devices.

* * * * *